US012295409B2

(12) United States Patent
Barenboym

(10) Patent No.: US 12,295,409 B2
(45) Date of Patent: May 13, 2025

(54) SMOKE CLEARING AND COOLING INSERT AND CANNABIS SMOKING IMPLEMENTS USING THEREOF

(71) Applicant: Michael Barenboym, Boston, MA (US)

(72) Inventor: Michael Barenboym, Boston, MA (US)

( * ) Notice: Subject to any disclaimer, the term of this patent is extended or adjusted under 35 U.S.C. 154(b) by 981 days.

(21) Appl. No.: 17/367,836

(22) Filed: Jul. 6, 2021

(65) Prior Publication Data

US 2021/0329967 A1 Oct. 28, 2021

Related U.S. Application Data

(63) Continuation-in-part of application No. 16/533,223, filed on Aug. 6, 2019, now Pat. No. 11,076,637.

(51) Int. Cl.

| | |
|---|---|
| ***A24F 1/16*** | (2006.01) |
| ***A24F 1/30*** | (2006.01) |
| ***A24F 1/32*** | (2006.01) |
| ***A24F 3/02*** | (2006.01) |
| ***A24F 7/02*** | (2006.01) |

(52) U.S. Cl.

CPC ..... *A24F 1/16* (2013.01); *A24F 1/30* (2013.01); *A24F 1/32* (2013.01); *A24F 3/02* (2013.01); *A24F 7/02* (2013.01)

(58) Field of Classification Search

CPC ..... A24F 1/16; A24F 1/28; A24F 1/32

See application file for complete search history.

(56) References Cited

U.S. PATENT DOCUMENTS

| | | | | |
|---|---|---|---|---|
| 879,796 | A | 2/1908 | Plane | |
| 1,261,038 | A | 4/1918 | Labreche | |
| 1,478,976 | A * | 12/1923 | Maier | A24F 1/00 131/217 |
| 2,035,398 | A | 3/1934 | Muller | |
| 2,033,867 | A | 3/1936 | Segal | |
| 2,190,312 | A | 2/1940 | Cullen | |
| 2,273,858 | A | 2/1942 | Gesek | |
| 2,354,712 | A | 8/1944 | Stieger | |
| 2,385,651 | A | 9/1945 | Ricketts | |
| 2,462,446 | A | 2/1949 | Wellborn | |
| 2,502,545 | A | 4/1950 | Wellborn | |

(Continued)

FOREIGN PATENT DOCUMENTS

| | | |
|---|---|---|
| CH | 628507 | 3/1982 |
| FR | 446338 | 12/1912 |
| SU | 6818 | 10/1928 |

*Primary Examiner* — Eric Yaary

(74) *Attorney, Agent, or Firm* — Boris Leschinsky

(57) ABSTRACT

A compact pipe or an insert assembly for smoking cannabis features an elongated pathway for smoke prior to entering the mouthpiece so as to cause smoke cooling and purification by removal of smoking debris along the pathway. An elongated serpentine groove is formed on the exterior of an elastic stem insert configured for insertion into a rigid outer shell during the pipe assembly. Elastic stem insert also serves to brush off smoke stains and deposits of smoke debris from the inside of the outer shell, making cleaning of the pipe easy and convenient. A smoke chamber is formed below the cannabis container to cause even distribution of air and smoke flow throughout the volume of cannabis to eliminate the need to frequently light up the pipe during use. An insert assembly is also described for use with bongs and other smoking implements.

12 Claims, 10 Drawing Sheets

(56) References Cited

U.S. PATENT DOCUMENTS

| | | | | | |
|---|---|---|---|---|---|
| 2,815,030 | A | | 12/1957 | Wenger | |
| 2,827,903 | A | | 3/1958 | Niederman | |
| 3,174,487 | A | | 3/1965 | Missler | |
| 3,490,461 | A | | 1/1970 | Osmalov | |
| 3,881,499 | A | * | 5/1975 | McFadden | A24F 1/30 131/222 |
| 4,014,353 | A | | 3/1977 | Kahler | |
| 4,029,109 | A | | 6/1977 | Kahler | |
| 5,896,860 | A | | 4/1999 | Lockett | |
| 2018/0035709 | A1 | | 2/2018 | Lara | |

* cited by examiner

SMOKE CLEARING AND COOLING INSERT AND CANNABIS SMOKING IMPLEMENTS USING THEREOF

CROSS-REFERENCE DATA

The present patent application is a continuation-in-part of the co-pending U.S. patent application Ser. No. 16/533,223, filed 6 Aug. 2019 and entitled "Compact pipe for smoking cannabis", which is incorporated herein by its entirety by reference.

BACKGROUND

Without limiting the scope of the invention, its background is described in connection with smoking pipes and other smoking implements. More particularly, the invention describes an insert for a smoking pipe, or a bong adapted for smoking cannabis.

The use of pipes and other implements for the consumption of smoked organic products is well known in the art. There are numerous types of pipes that have been used over the years to smoke tobacco.

With many states now allowing the medical use of cannabis, and at least several states at the present time allowing the recreational use of cannabis by anyone of legal age, there is a renewed interest in pipes that are designed specifically for smoking cannabis. Of course, any of these smoking pipes can also be used with tobacco or other smoking substances.

There are numerous types of pipes used to smoke cannabis and other organic products. These generally include water pipes, bongs, hookahs, straight pipes, steamroller pipes, briar pipes, and numerous specialty pipes. Many pipes for smoking cannabis are small and made of glass since glass avoids any interaction of the heated smoke with wood or other material. Glass pipes however are fragile and tend to get hot. There is a need for a smoking pipe that does not contain brittle materials such as glass.

One common element of various cannabis smoking implements is a narrow stem which may be a long flexible or rigid tube. The smoking material is conventionally placed in the receptacle and lit with a heat source while air is drawn through the bowl and across the long stem towards the user. However, the typical glass pipe is fragile and difficult to clean, and it usually has only one fixed bowl of various sizes and shapes.

There are two benefits of providing a long tube between the smoking material and the mouthpiece: to cool the smoke along the way so as to prevent the risk of inhaling hot smoke, which may cause lung injuries; and to remove various smoking debris and inclusions in the smoke such as unburnt pieces of plant, droplets of tar or oil, etc. While these long devices may serve these purposes well, their size makes them problematic for travel or transport purposes. There is a need for a compact cannabis pipe having these same benefits in a smaller size package.

Another issue with using conventional pipes and devices for smoking cannabis is cleaning these devices—after a few uses, smoking deposits cover the insides of the device making it necessary to clean. Removing smoking deposits from small crevices and passages inside many conventional smoking pipes is difficult and tedious. Frequently, these smoking devices contain a large number of interconnected parts which are difficult to disassemble, remove the stains and debris, and then put together again. The need exists for a cannabis smoking pipe that is easy to clean.

A further limitation of current pipes for smoking cannabis and other smoking materials is that they require multiple starter lighting throughout use. If the user does not frequently draw smoke through the pipe, the burning of the smoking material often goes out. In that case, resuming smoking requires the user to light the pipe again. This may occur several times, whereby repeated efforts to light the pipe making smoking to be less enjoyable. The need exists to have a smoking pipe that remains lit after the start of a smoking session.

SUMMARY

Accordingly, it is an object of the present invention to overcome these and other drawbacks of the prior art by providing a novel insert or a compact pipe for smoking cannabis or other organic smoking material containing an elongated smoke pathway so as to cool and purify smoke before entering the mouthpiece of the pipe.

It is another object of the present invention to provide an insert for a pipe for smoking cannabis, whereby the pipe has just a few parts that are easy to take apart and clean.

It is yet a further object of the present invention to provide a bong insert for clearing the smoke from debris and for cooling the smoke before inhaling by the user.

The insert assembly for cannabis smoking contains an elongated smoke pathway arranged in a convoluted serpentine shape. The smoke pathway is formed as a serpentine groove made along an external surface of an elongated elastic stem insert. The pathway for smoke is formed when the elastic stem insert is placed inside a rigid outer shell with a smooth internal surface having an inner diameter slightly smaller than the outer diameter of the external portion of the elastic stem insert—so as to provide for a secure friction fit between these two components when the stem insert is compressed inside the outer shell.

The elastic stem insert may be made in some embodiments together with a pipe bowl protruding from one end thereof and having a well for receiving smoking material therein, such as a single- or repeated-use container filled with cannabis. The container may be made of metal with a built-in screen so as to retain ash and other non-burnt particles inside thereof during and after the completion of a smoking session. Drawing air through a mouthpiece during inhalation causes the smoke from burning cannabis to travel from the pipe bowl or from another smoking implement along the elongated smoke pathway between the elastic stem insert and the rigid outer shell where it cools off. The convoluted shape of the pathway causes droplets and other rigid and liquid smoke debris and inclusions to deposit on the walls of the pathway which prevents inhaling thereof by the user.

Also described is a compact insert for use with bongs and other smoking implements, the insert featuring a combination of an elastic stem and a rigid tube surrounding thereof, wherein the elastic stem features a similar elongated smoke pathway arranged in a convoluted shape. Inhaling smoke through the insert causes the smoke to travel through the convoluted pathway to cool down and clear from floating debris prior to inhalation by the user.

BRIEF DESCRIPTION OF THE DRAWINGS

Subject matter is particularly pointed out and distinctly claimed in the concluding portion of the specification. The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through the use of the accompanying drawings, in which:

DETAILED DESCRIPTION OF PREFERRED EMBODIMENTS OF THE INVENTION

Figure 1:
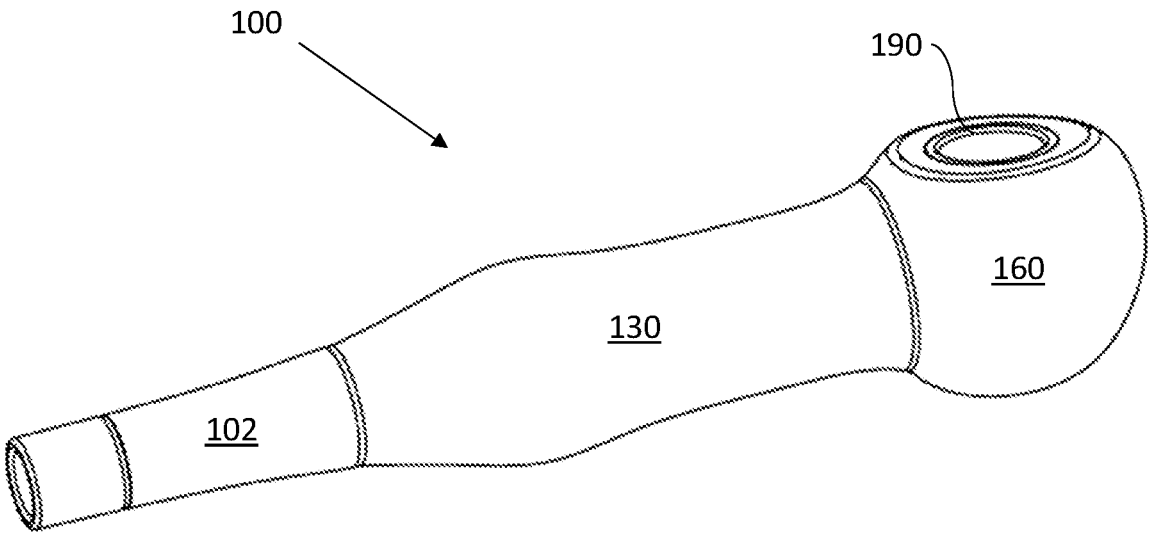
FIG. 1 is a perspective view of the pipe assembly of the first embodiment of the present invention.
Figure 2:
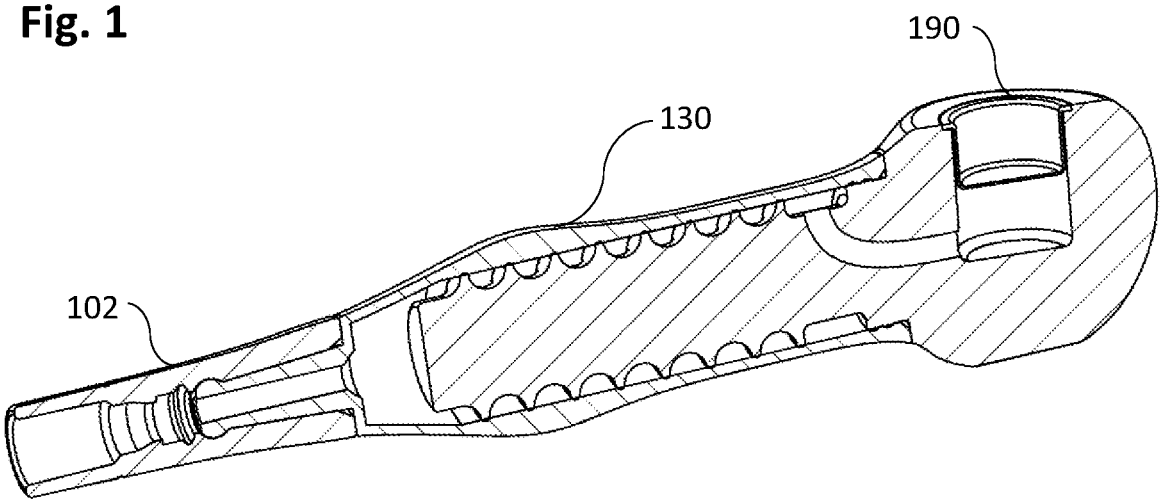
FIG. 2 is a perspective view showing a longitudinal cross-section of the same as in FIG. 1.
Figure 3:
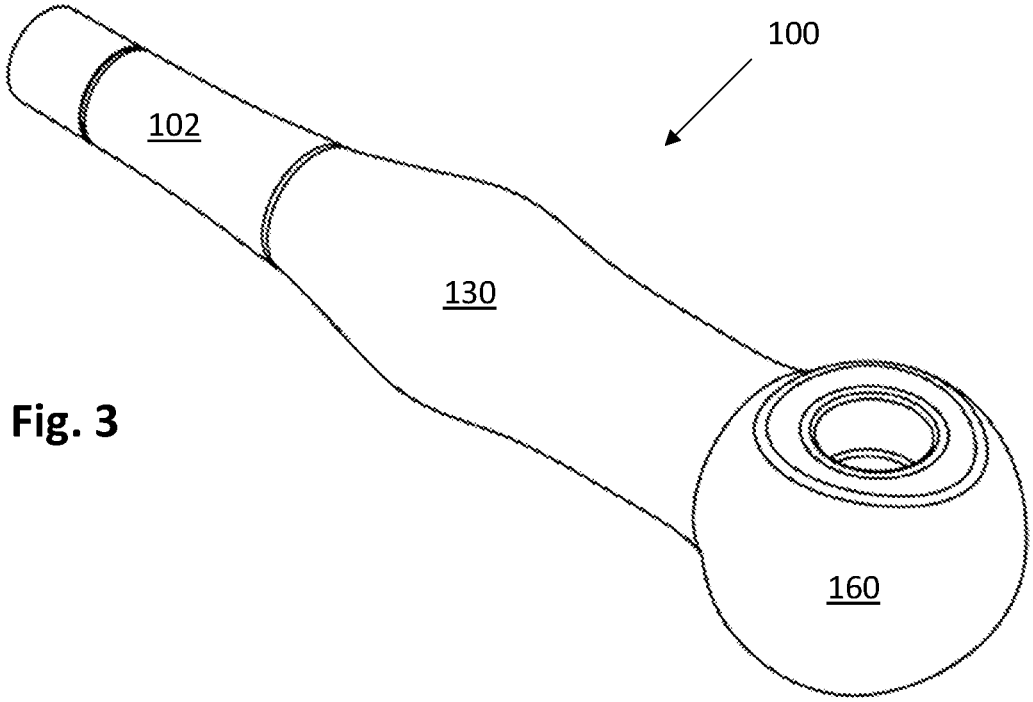
FIG. 3 is another perspective view of the present invention.
Figure 4:
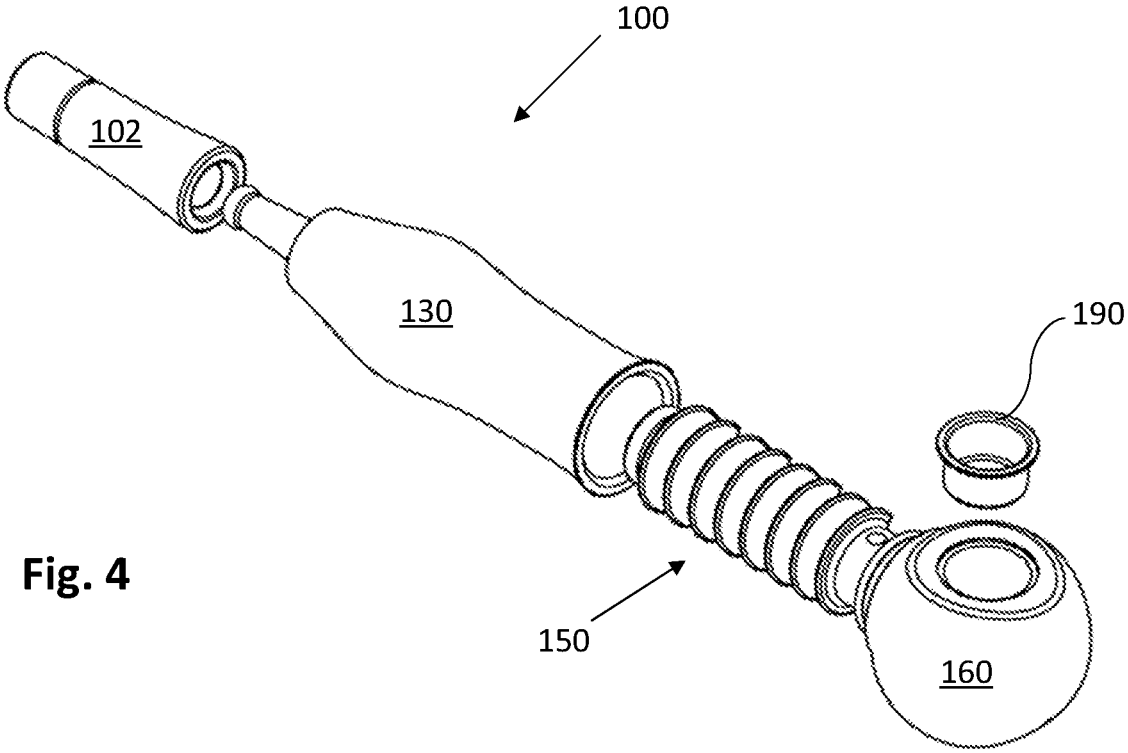
FIG. 4 is an exploded perspective view of the pipe of the present invention showing all components thereof.
Figure 5:
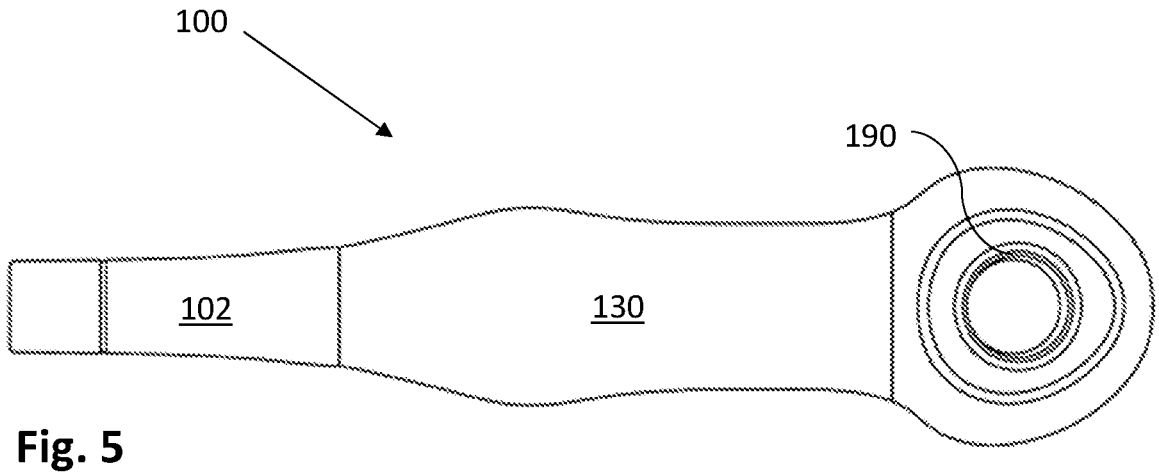
FIG. 5 is a top view of the smoking pipe of the invention.
Figure 6:
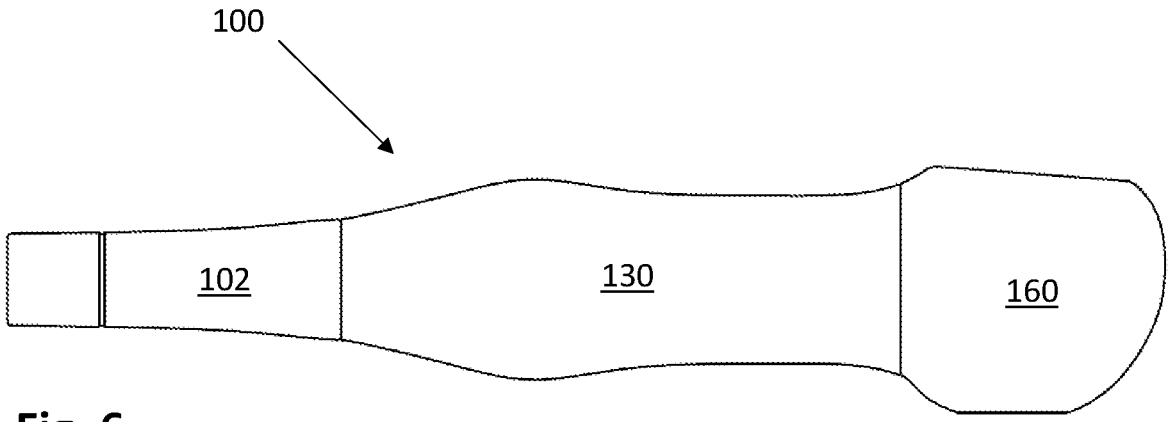
FIG. 6 is a side view of the same.
Figure 7:
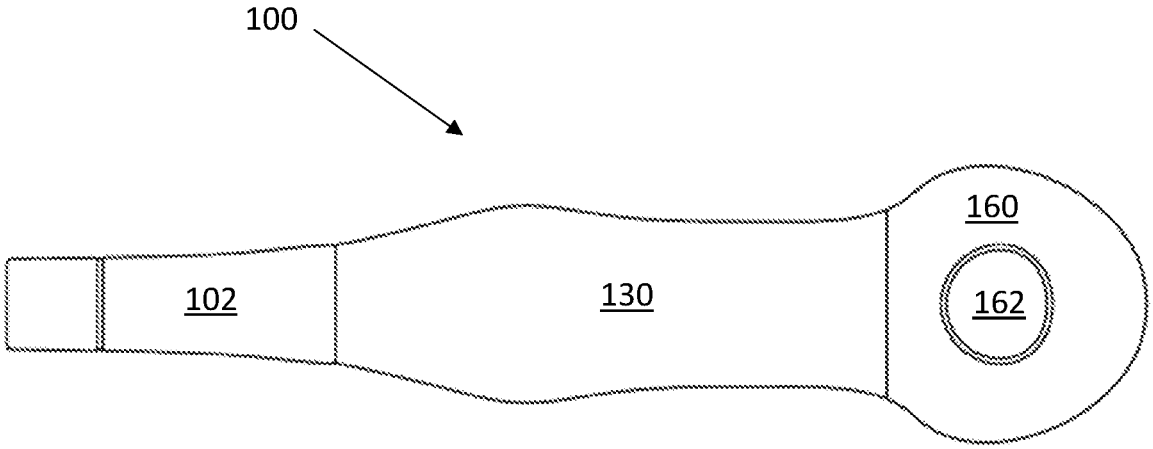
FIG. 7 is a bottom view of the same.

The following description sets forth various examples along with specific details to provide a thorough understanding of claimed subject matter. It will be understood by those skilled in the art, however, that claimed subject matter may be practiced without one or more of the specific details disclosed herein. Further, in some circumstances, well-known methods, procedures, systems, components and/or circuits have not been described in detail in order to avoid unnecessarily obscuring claimed subject matter. In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and make part of this disclosure.

FIGS. 1 through 7 show various views of the smoking pipe assembly of the first embodiment of the present invention. The pipe 100 for smoking cannabis generally consists of four major components: a mouthpiece 102, a rigid outer shell 130, an elastic stem insert 150 made together with the bowl 160 as a single unit, and a cannabis container 190 configured to fit in the opening of the bowl well 164.

The mouthpiece 102 may be generally made from an elastic material and may optionally contain a screen or a filter within thereof. In embodiments, the mouthpiece 102 may be made using the principles and concepts described in my co-pending U.S. patent application Ser. No. 16/445,189 entitled "UNIVERSAL ELASTIC IMPLEMENT FOR SMOKING TOBACCO, CANNABIS AND E-CIGARETTES WITH A BUILT-IN SCREEN", filed 18 Jun. 2019 and incorporated herein by reference in its entirety. In particular, it may be sized to allow for an elastic engagement with a corresponding feature of the outer shell 130 described below in greater detail—so as to allow removal and replacement if needed.

The cannabis container 190 may be made from a metal such as steel or aluminum, which may be drawn to form a cavity containing cannabis or another smoking material. The desired amount of cannabis may be placed inside and retained therein at the beginning or prior to the smoking session. Typically, such a container may have a bottom containing small openings in the form of a screen, such openings or pores may be sized to allow unobstructed passage of smoke and air therethrough but prevent or at least restrict a passage of larger solid particles or fluid droplets. When the cannabis is lit, container 190 may be configured to retain the organic smoking material inside while it is slowly burning, such that an airflow initiated by the inhaling effort of the user may carry the smoke towards the user's lungs. Once the smoking session is finished, container 190 may be discarded and replaced with a new one in order to avoid the need to clean thereof from the ash and organic smoking debris remaining therein. The bottom screen in that case serves as a first-line filter to prevent undesirable particles and droplets of tar from moving towards the user.

Figure 8:
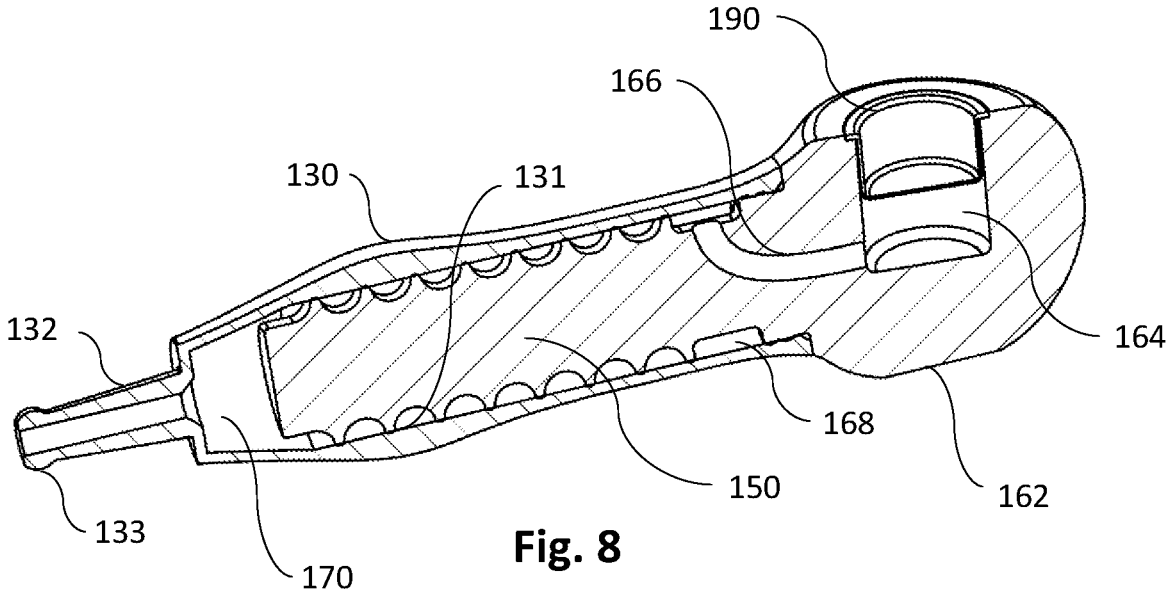
FIG. 8 is a cross-sectional perspective view of the subassembly of the smoking pipe of the present invention with the mouthpiece being removed.
Figure 9:
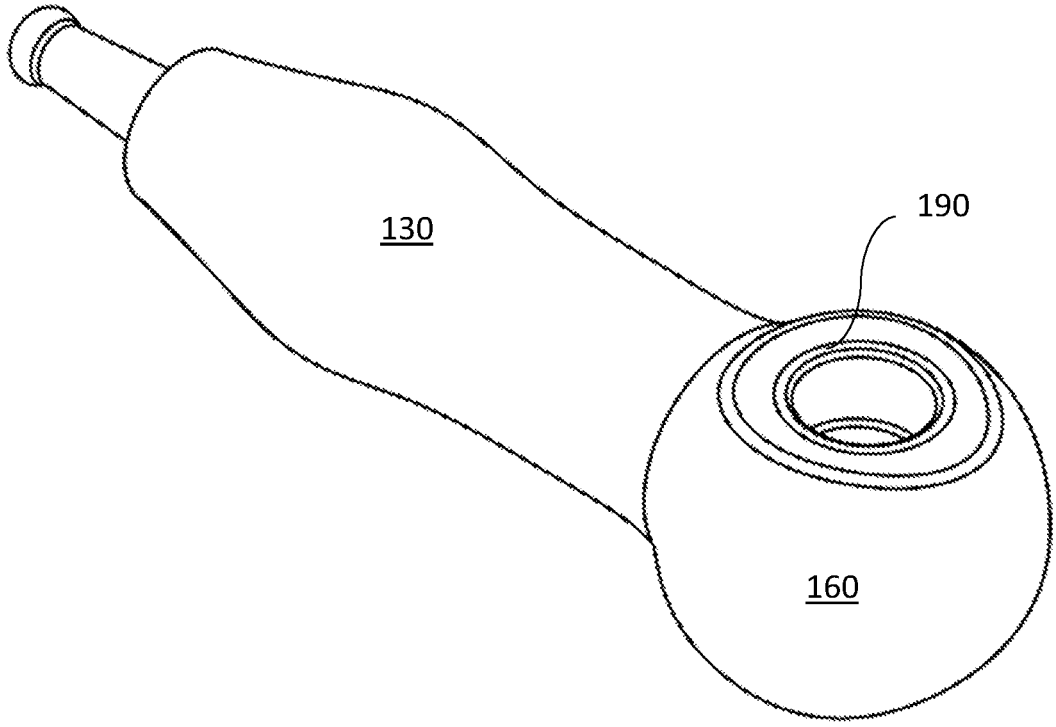
FIG. 9 is a perspective view of the same.

Other main components of the pipe of the invention are shown as a subassembly in FIGS. 8 and 9 where the mouthpiece 102 is removed. The rigid outer shell 130 may be shaped externally as a generally round pipe holder and may contain an extension 132 sized and designed to be engaged with an elastic mouthpiece 102 using a bulbous tip 133. A generally cylindrical and elongated inner well with an interior wall 131 and an open end may be made inside the outer shell 130—see FIG. 4.

The outer shell 130 may be made using a thermo-conductive material such as a metal, aluminum for example, which may be optionally anodized using various colors to achieve an esthetically pleasing appearance. In other embodiments, the outer shell 130 may be made of semi-rigid materials with sufficiently greater stiffness as compared to the elastic insert 150, such as for example at least 2 times greater stiffness. This approach also allows for easy customization of the pipe of the invention by using different colors or color patterns on the exterior surface of the outer shell 130. Use of a thermo-conductive material for the outer shell 130 at least in some embodiments allows quick dissipating of the heat coming from the hot smoke traveling along the serpentine pathway inside the outer shell 130. In embodiments, the length of the outer shell 130 excluding the extension 132 may be from about 1.5 inches to about 4 inches so as to make the entire pipe have a compact size and small weight—therefore facilitating its easy transport.

Figure 10:
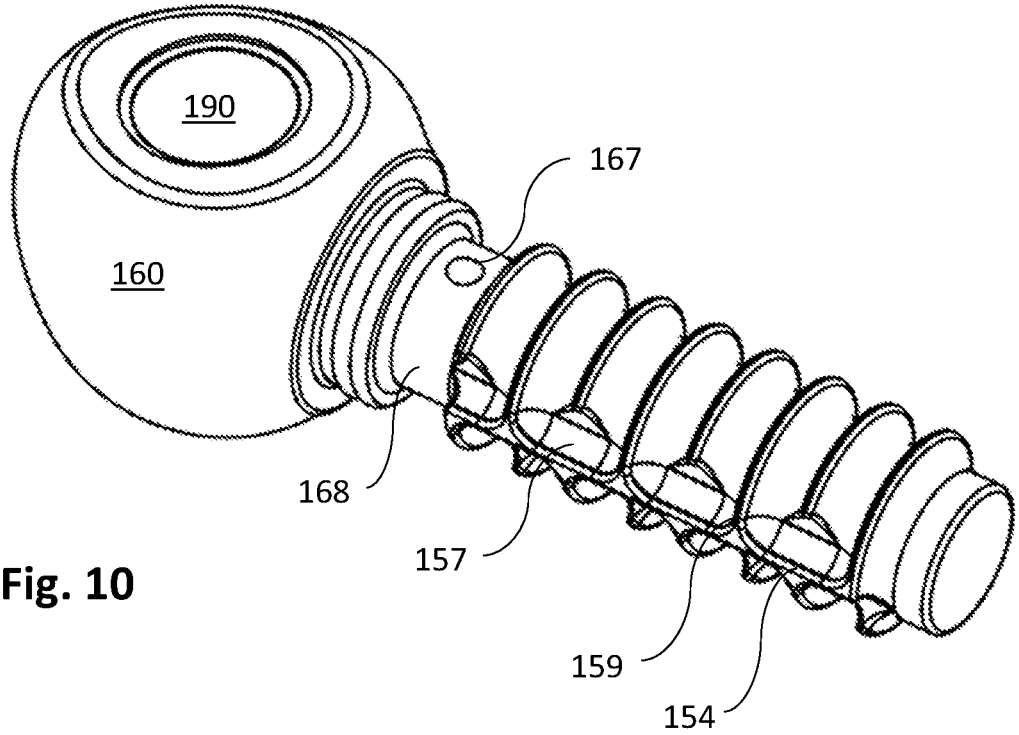
FIG. 10 is a perspective view of the elastic stem insert.
Figure 11:
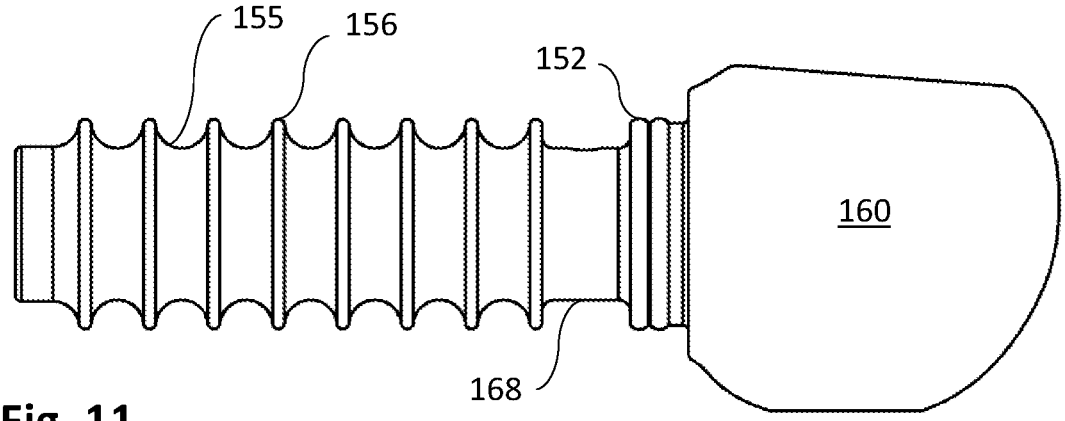
FIG. 11 is a side view of the same.
Figure 12:
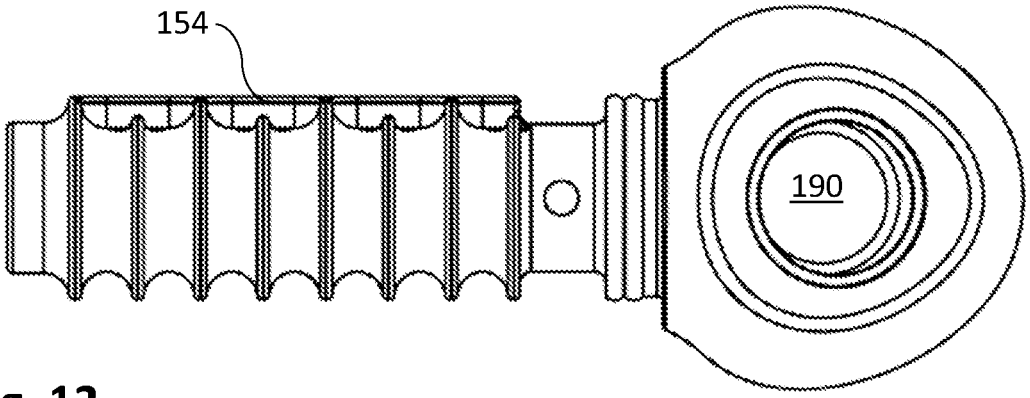
FIG. 12 is a top view of the same.

The elastic elongated stem insert 150 may be configured for insertion into the open end of the outer shell 130. It may be made together with the pipe bowl 160 as a single unit and from the same elastic material, as shown in greater detail in the views seen in FIGS. 10, 11, and 12. The pipe bowl 160 protruding from one end of the stem insert 150 may be made in a generally ball-like shape with an optional flat portion 162 designed to prevent the pipe from rolling around when placed onto a hard surface such as a desk or a table.

The pipe bowl 160 may have a bowl well 164 sized to serve as a receptacle for the smoking material, such as the cannabis container 190 that may be positioned with a friction fit inside thereof—see FIG. 8. The bottom of the bowl well 164 may contain a passage 166 operably connecting the bowl well 164 through the opening 167 to the exterior of the circular smoke entry 168 in the elastic stem insert 150. The size of the pipe bowl may be about 1 to 1.5 inches in diameter as the invention is not limited in this regard.

While conventionally the bowl well 164 may be filled entirely with the smoking material or occupied with the cannabis container 190 throughout its internal volume, it may cause frequent interruptions of the burning process of cannabis unless the user frequently draws air through the pipe to keep the burning process going. This is because the opening of passage 166 leading the smoke towards the user is generally small in comparison to the size of the bowl well 164. As such, all air flowing through the volume of the smoking material such as cannabis has to find a narrow path through the compacted smoking material and into passage 166. That limited airflow may be able to maintain continuous burning only at some portions of the smoking material volume, while other portions of that volume are not exposed to periodic draws of air and therefore are at increased risk of the burning process going out.

The present invention addresses this problem by arranging the flow of air to be evenly distributed throughout the entire volume of the smoking material so as to maintain the slow-burning process for a longer time, thereby reducing or even eliminating the need to light the pipe multiple times during a single smoking session. This is accomplished by providing a smoke chamber between cannabis container 190 and passage 166. In its simplest form, the smoke chamber is formed under the cannabis container 190 by providing the bowl well 164 to have greater depth than the size of the cannabis container 190—see FIG. 8. In embodiments, the height of the space in the bowl well below the cannabis container forming the smoke chamber may be at least the same as the size of the passage 166 or greater than this size. In this case, drawing smoke through passage 166 causes a vacuum to be formed in the smoking chamber below the cannabis container 190. Since the cannabis container 190 may feature a screen extending throughout its bottom, the vacuum from the smoking chamber will be evenly distributed throughout the screen on the bottom of the smoking container 190, which in turn will lead to airflow evenly penetrating and proceeding throughout the entire volume of the smoking material inside the smoking container 190. This more uniform airflow throughout the volume of the cannabis compacted in the smoking container 190 causes multiple portions of the cannabis load to maintain a slow-burning process for an extended period of time—whereby addressing the nuisance problem of the burning process going out before completing the smoking session.

The elastic elongated stem insert 150 may be made to have a generally cylindrical shape sized to extend most of the way through the open end and along the interior wall 131 of the outer shell 130. In embodiments, the length of the elastic stem insert may be less than the length of the inner well inside the outer shell 130 by anywhere between 0.25 and 0.75 inches so as to create a smoke mixing cavity 170 sized to be at least 3 times larger in size than the serpentine smoke pathway 158, see FIG. 8. Mixing of the smoke drawn into the smoke mixing cavity 170 helps to make the smoking experience more uniform and avoid fluctuations of smoke temperature and concentration between inhalations of various strengths.

The end of the elastic stem insert closest to the bowl 160 may be equipped with one or a series of elastic O-rings 152 (see FIG. 11), optionally built into the body of the elongated stem insert 150 and sized to seal the interior wall 131 about and against the elastic stem insert 150 when the smoking pipe 100 is assembled.

The present invention provides an elongated smoke pathway extending from bowl 160 towards the mouthpiece 102. In order to reduce the length of the pipe 100 to a compact size, the smoke pathway is arranged to have a serpentine shape. This may be achieved by providing one or several parallel convoluted serpentine grooves on the exterior of the elongated stem insert. Sealing the groove against the interior wall 131 forms the serpentine smoke pathway of pipe 100. One exemplary way to arrange for this groove is now described in greater detail.

The elastic elongated stem insert 150 may contain a plurality of circular ribs 156 spaced along thereof and positioned generally orthogonal to the longitudinal axis of the smoking pipe of the invention—with radial grooves 155 formed between respective pairs of adjacent circular ribs 156. While in some embodiments the space between adjacent circular ribs 156 may be the same for all successive circular ribs 156, in other embodiments, the spacing of the circular ribs 156 may be provided with a changing distance between the adjacent ribs.

In one example, circular ribs 156 located closer to the pipe bowl 160 may be positioned closer to each other as compared with circular ribs 156 located further towards the mouthpiece 102. Initially narrower smoke passages can allow for better removal of the smoking debris particles and tar droplets as the smoke enters the pipe 100 and travels through smaller grooves between the circular ribs 156 as explained in further detail below.

Yet, in further embodiments of the invention, the opposite may be the case, where the circular ribs 156 located closer to the bowl 160 may be positioned further away from each other as compared to the circular ribs 156 on the other end of the elongated stem insert 150. This arrangement may be used for better temperature control forcing a greater contact of the hottest smoke entering the handle of the pipe to be cooled off by heat-dissipating metal outer shell 130.

Figure 15:
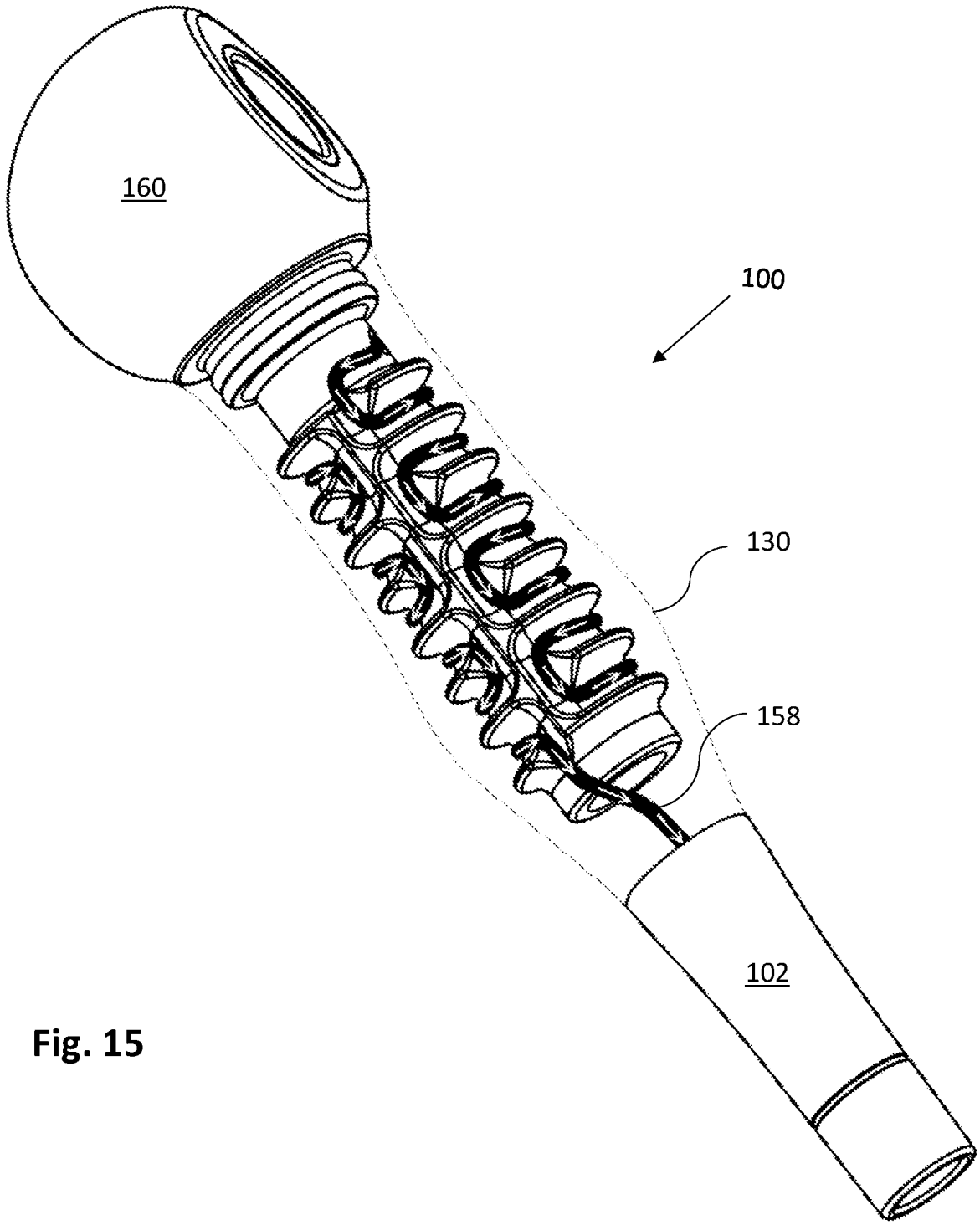
FIG. 15 shows a smoke pathway extending through the pipe of the invention.

Also formed along the elastic stem insert 150 is a side rib 154 traversing the distance between the first and the last circular rib 156. Each of the circular ribs 156 may be made to initiate and extend from the side rib 154 on one side 159 thereof and then to extend around the stem insert 150 in a circular pattern but not to reach the side rib 154 on the other side thereof—forming a gap 157 to allow the smoke to pass from one side of the circular rib 156 to the other. The gaps 157 between the circular ribs 156 and the side rib 154 may be located on alternating sides of the side rib 154 so as to form portions of said convoluted serpentine groove. Alternating the location of the gaps 157 on either side of the side rib 154 forms an extended convoluted serpentine smoke pathway groove 158 (see FIG. 15) with individual radial grooves 155 extending in alternating directions around the stem insert 150. The serpentine groove, in this case, may be made for traversing the length of the pipe 100 from the bowl 160 to the mouthpiece 102 and featuring a plurality of radial grooves 155 with alternating entry and exit points along the side rib 154. The smoke pathway, therefore, features a plurality of segments with the alternating direction of smoke propagation from one radial groove 155 to the next.

In embodiments, the total length of the smoke pathway (with the outer shell 130 in place to force the smoke to pass along the circular ribs 156 and not across them) may be from about 2 inches and higher, such as 2; 2.5; 3; 3.5; 4; 4.5; 5; 5.5; 6; 6.5; 7; 7.5; 8; 9; 10; 11; 12; 13; 14; 15; 16; 17; 18; 19; 20 inches or more as the invention is not limited in this regard. As can be appreciated by those skilled in the art, the length of the smoke pathway may be selected to both satisfy the objectives of reduced temperature and enhanced smoke purification on one side and not to make the smoking pipe of the invention unnecessarily large on the other side.

In further embodiments contemplated by the present invention, more than one serpentine smoke pathway may be formed using respective parallel serpentine grooves formed on the exterior of the elongated stem insert 150 (not shown).

The elastic stem insert 150 and the pipe bowl 160 may be made from a single elastic material. It may be beneficial to use a thermo-insulating, biocompatible elastic material so as to assure the safety of the user. In embodiments, the selection of the suitable material may be made with consideration of a melting temperature thereof, which may be selected to be above the expected temperature of the burning cannabis—so as to avoid melting or another distortion or damage of the smoking pipe 100 during use.

Various individual colors and color mixtures may be added to the elastic material of the elongated stem insert 150. This may be done to allow several users to easily identify their own smoking pipe and avoid cross-contamination when a number of smoking pipes are used by a group of users at the same time.

Finally, the elastic material should have a sufficient extent of elasticity to allow an airtight fit of the stem insert 150 inside the outer shell 130—and yet allow for its removal and insert to be done without excessive effort. In embodiments, the elastic material for the stem insert 150 may be selected with shore A durometer ranging from about 40 to about 70, or in a range from medium soft to medium hard.

Polyethylene, polyurethane, polypropylene, natural rubber, silicone, or combinations thereof are all suitable examples of a material for the body of the stem insert 150. In addition to the above-listed considerations, the use of these materials may allow easy washing of the components of the smoking pipe 100 with conventional soap and water or even in a dishwasher to remove smoking debris and stains therefrom.

The elastic stem insert 150 and the pipe bowl 160 may be manufactured as a single unit using conventional polymer production techniques including molding, overmolding, insert molding, vacuum forming, casting, dip coating, etc. as the invention is not limited in this regard.

In embodiments, the outer diameter of the circular ribs 156 and optionally the side rib 154 may be made to match or exceed that of the inner diameter of the interior wall 131 of the outer shell 130 so as to assure compression of the stem insert 150 and an air-tight fit inside the outer shell 130. In embodiments, the size of the stem insert may exceed the size of the outer shell inner well by 0.025; 0.05; 0.075; 0.1; 0.125 inch or any suitable size difference in between as the invention is not limited in this regard.

In addition to providing a tight fit for securing one component inside the other, oversizing the circular ribs 156 and the side rib 154 may help in using the stem insert 150 as a brush to remove smoking debris from the inside of the outer shell 130 after the smoking session is finished. To accomplish this, the stem insert 150 may be removed and reinserted once or multiple times inside the outer shell 130 whereby scrubbing the interior wall 131 thereof. Cleaning the stem insert 150 itself may also be less burdensome as the elastic surface may be easily manipulated to dislodge smoking debris that may adhere thereto.

Figure 13:
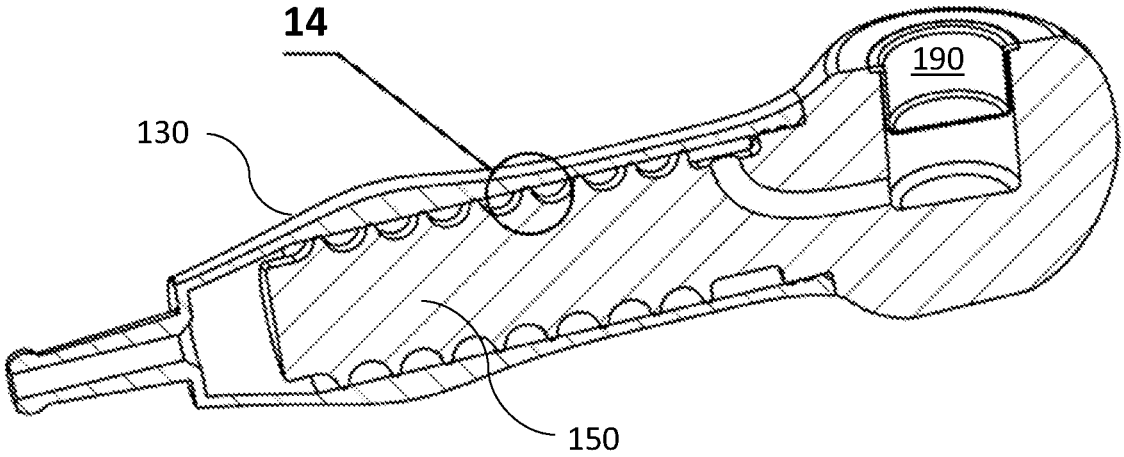
FIG. 13 is a perspective cross-sectional view of the subassembly showing interaction between the elastic stem insert and the outer rigid shell, FIG. 14, panels A through F show an enlargement of the region indicated in FIG. 13.
Figure 14:
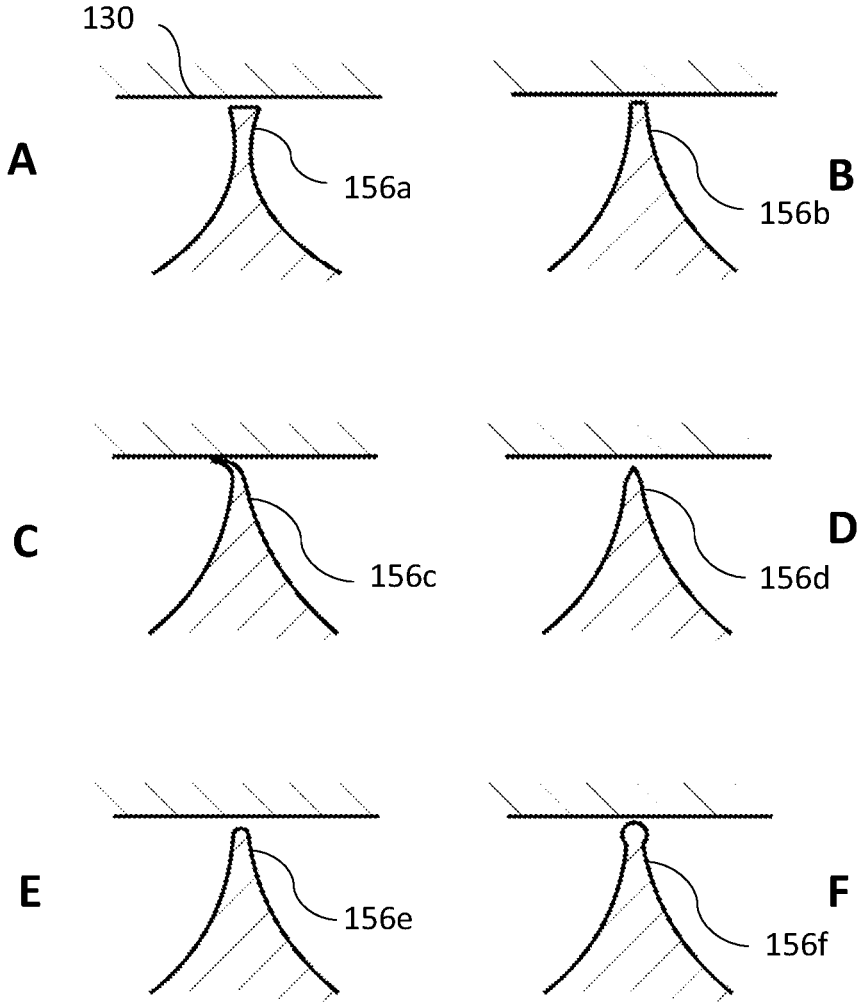

To further facilitate the cleaning of the smoking pipe of the present invention, the outer edge of the circular ribs 156 may have a shape advantageous for scrubbing the interior wall 131 as seen in FIG. 13 and a close-up in FIG. 14. Shown here in panels A through F are examples of various shapes of the outer edge **156*a* through 156*f* that may be advantageous to improve the fit of the stem insert 150 inside the outer shell 130 as well as cleaning of the interior wall 131. In particular, 156*a* shows an outer edge with an enlarged square tip, 156*b* shows a straight square tip, 156*c* shows a bent pointed tip, 156*d* is a straight pointed tip, 156*e* is a rounded tip, and 156*f*** is a bulbous tip.

To further facilitate the cleaning of the inner well of the outer shell 130 using the elongated stem insert 150 as a brush and the pipe bowl 160 as a brush handle, the tips of the circular ribs 156 may be made with semi-rigid or rigid inserts such as metal inserts matching the interior profile of the outer shell 130—so that reciprocal motion of the stem insert 150 inside the outer shell 130 produces active scrubbing of its interior wall 131. Such rigid inserts may be provided to be embedded into the elastic material of the stem insert 150 so as to not jeopardize the seal of the outer shell 130 about the stem insert 150 and leakage of smoke across the circular ribs 156 while in use.

FIGS. 16-22 illustrate a second embodiment of the present invention, an insert assembly 200 that can be positioned on the outlet port 260 of a bong or another smoking implement. Typically, unfiltered hot smoke from burning cannabis is directly inhaled by the user from outlet port 260. Using the present invention helps to clear the smoke from burning debris as well as to cool it down before inhalation by the user.

Figure 16:
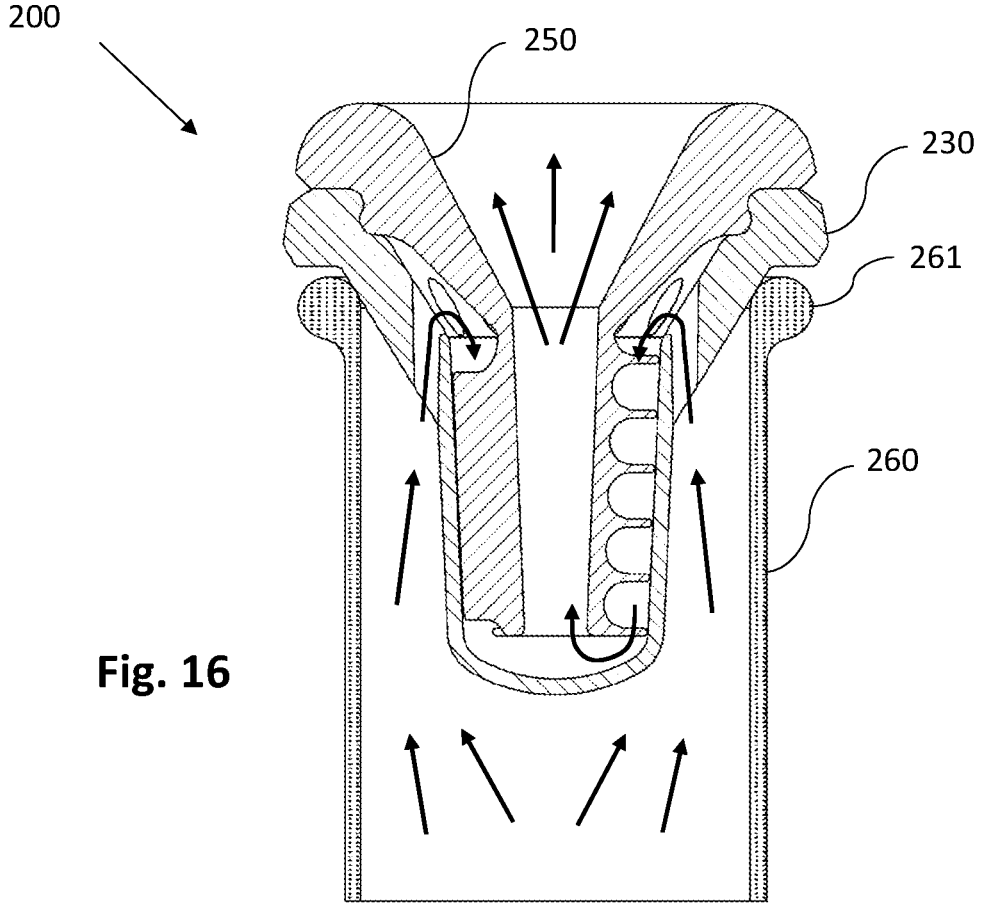
FIG. 16 shows an insert assembly at the outlet port of a smoking bong according to the second embodiment of the invention.

The insert assembly 200 may be sized and configured to fit at the edge 261 of the outlet port 260 as shown in FIG. 16. The fit between the insert assembly 200 and the outlet port 260 may be loose or tight as desired based on a specific application. In some embodiments, a tight friction fit may be arranged so as to seal off port 260 and prevent smoke from escaping outside the insert assembly 200 (not shown in the drawings).

Figure 17:
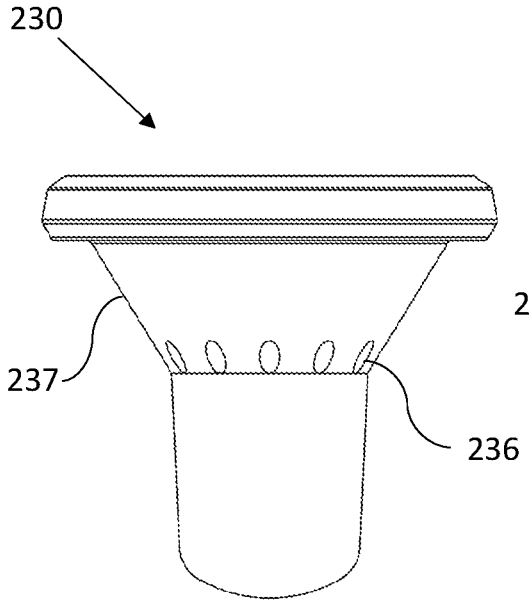
FIG. 17 shows a side view of a rigid housing of the insert assembly.
Figure 18:
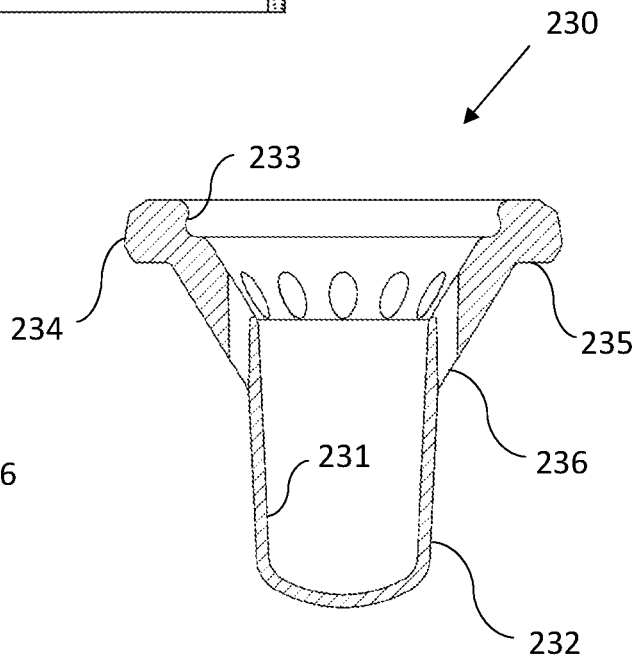
FIG. 18 shows a cross-sectional side view of the same as in FIG. 17.

The insert assembly 200 comprises a rigid insert body 230 and an elastic stem 250 sealingly positioned inside the insert body 230. FIGS. 17 and 18 show the details of the insert body 230, which comprises a hollow tube 232 with a closed end on one side and an expanding tapered end 237 on the other end. The rigid insert 230 may be made from a thermo-stable polymer, glass, ceramic, or metal. The polymer suitable for making the rigid insert 230 may be entirely rigid or at least more rigid than the elastic stem 250 so as to allow for a tight seal between these two components.

The rigid insert 230 features a hollow outer shell 232 with an optionally cylindrical inner well 231 and a series of peripherally located openings 236 in the tapered end 237 to allow smoke to travel from outside the shell 232 to the area inside thereof. A flared-out opening 234 of the tapered end 237 may feature a rim 234 sized and shaped to match the respective outer geometry of the edge 261, for example by featuring a sealing surface 235. Having a tapered outer surface is also useful in fitting the insert assembly 200 to outlet ports 260 of different diameters as the invention is not limited in this regard. Other tight fitting and sealing arrangements between the outer surface of the insert 230 and the inner surface of the outlet port are also contemplated by the present invention (not shown in the drawings). For example, a heat-resistant O-ring may be positioned between the rigid insert 230 and the outlet port 260. The rim 234 may also feature an inside cutout with an internal surface 233 having a recess shaped for accepting and retaining a corresponding end of the elastic insert 250 in a sealing and snug manner.

Figure 19:
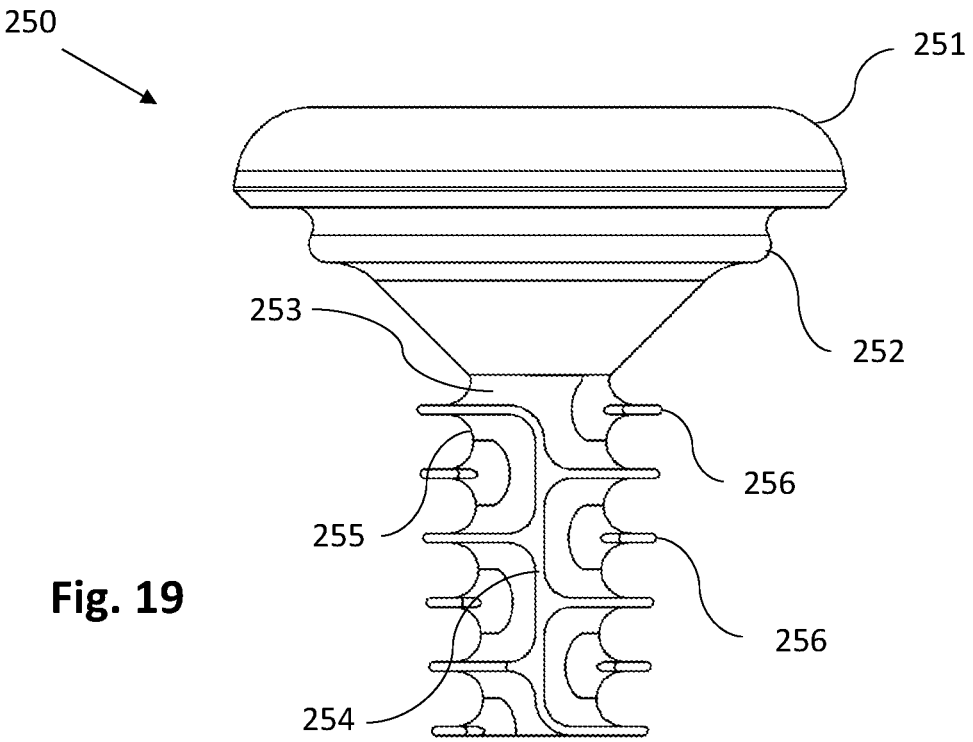
FIG. 19 shows a side view of the elastic stem of the insert assembly.
Figure 20:
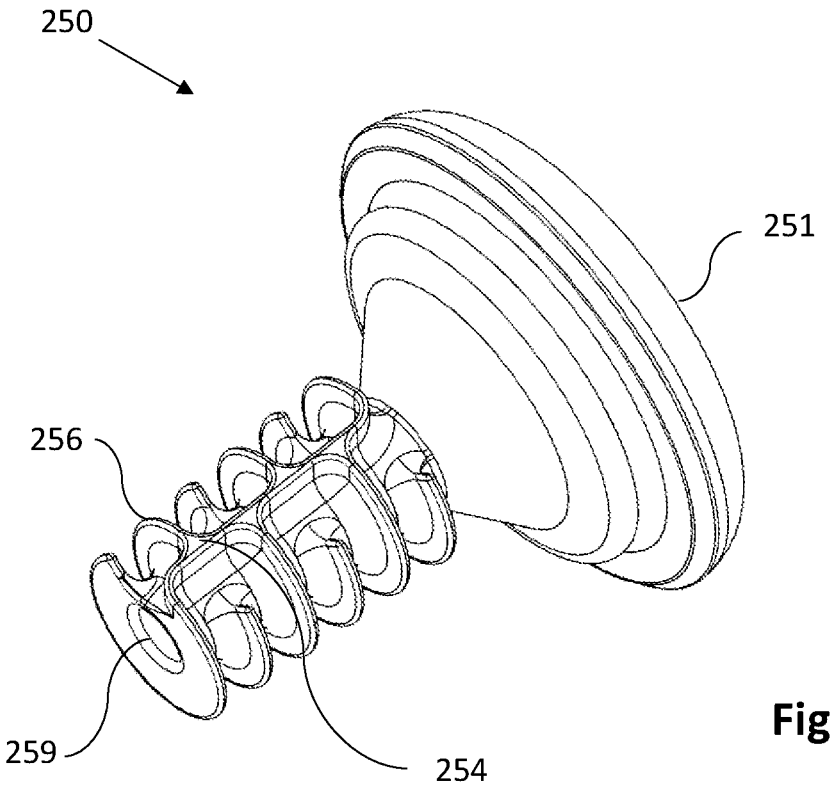
FIG. 20 shows a side perspective view of the same.

The elastic insert 250 is illustrated in greater detail in FIGS. 19 and 20. It broadly comprises an elastic cylindrical body 253 and a flared out mouthpiece 251. The mouthpiece 251 may be made together with the cylindrical body 253 as a single body or, in other embodiments, these parts may be made separately and joined together as an assembly. The flared out mouthpiece 251 may be made to have an outside tapered surface 252 matching that of the inner tapered surface 233 of the rigid insert 230 (as best seen in FIG. 16) for sealing retention of both components together once they are assembled.

The cylindrical body of the elastic insert 250 may be made in a way similar to the stem insert 150 as described above for the first embodiment of the invention. It forms a convoluted smoke pathway in the valleys 255 in between a series of circular ribs 256 abutting a longitudinal rib 254. The outer diameter of the circular ribs 256 may be selected to be at or slightly larger than the internal diameter of the rigid shell 232 so as to form a tight fit therewith upon assembly. A central smoke opening 259 in the middle of the elastic stem 250 is configured to provide an unimpeded smoke passage within thereof.

Figure 21:
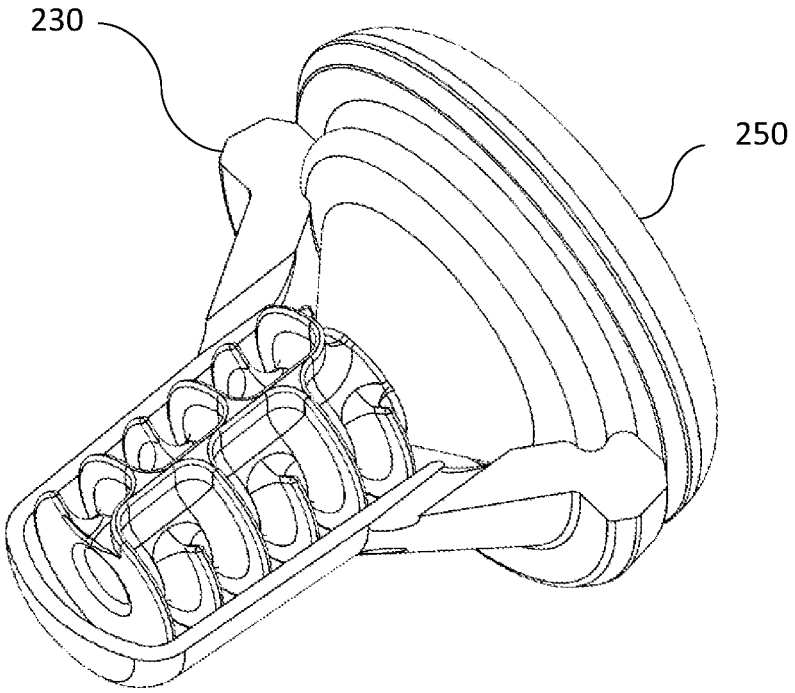
FIG. 21 shows a side perspective view of a partial cut-out of the insert assembly.
Figure 22:
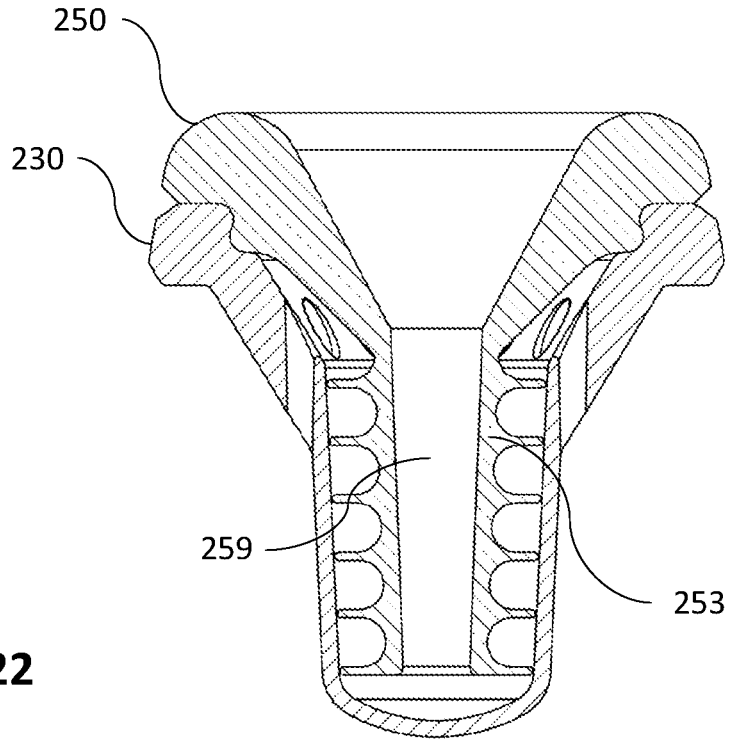
FIG. 22 shows a side cross-sectional view of the same.

Insert assembly 200 of the rigid insert body 230 and the elastic stem insert 250 is seen in various views in FIGS. 16, 21, and 22. FIG. 16 shows a smoke pathway throughout the entire device starting at the outlet port 260 and extending through the series of openings 236 to the top of the convoluted pathway (as seen in FIG. 16). From that point, the smoke travels around the circular ribs towards the opening 259 at the bottom of the elastic stem insert 250. Once at the bottom of shell 232, the smoke enters opening 259 and from that point may be inhaled directly through the mouthpiece 251.

Providing an elongated smoke pathway in a convoluted form as described herein allows the smoke to cool down prior to inhalation by the user. As an additional benefit, burning pieces of cannabis, debris, and other hard particles get entrapped on the walls of the elastic stem 253, which therefore prevents inhalation thereof by the user.

The insert assembly 200 may be easily disassembled from time to time and its components 230 and 250 washed using hot water in order to remove debris from its walls.

It is contemplated that any embodiment discussed in this specification can be implemented with respect to any method of the invention, and vice versa. It will be also understood that particular embodiments described herein are shown by way of illustration and not as limitations of the invention. The principal features of this invention can be employed in various embodiments without departing from the scope of the invention. Those skilled in the art will recognize or be able to ascertain using no more than routine experimentation, numerous equivalents to the specific procedures described herein. Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference. Incorporation by reference is limited such that no subject matter is incorporated that is contrary to the explicit disclosure herein, no claims included in the documents are incorporated by reference herein, and any definitions provided in the documents are not incorporated by reference herein unless expressly included herein.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps. In embodiments of any of the compositions and methods provided herein, "comprising" may be replaced with "consisting essentially of" or "consisting of". As used herein, the phrase "consisting essentially of" requires the specified integer(s) or steps as well as those that do not materially affect the character or function of the claimed invention. As used herein, the term "consisting" is used to indicate the presence of the recited integer (e.g., a feature, an element, a characteristic, a property, a method/process step or a limitation) or group of integers (e.g., feature(s), element(s), characteristic(s), propertie(s), method/process steps or limitation(s)) only.

The term "or combinations thereof" as used herein refers to all permutations and combinations of the listed items preceding the term. For example, "A, B, C, or combinations thereof" is intended to include at least one of: A, B, C, Aft AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, Aft BBC, AAABCCCC, CBBAAA, CABABB, and so forth. The skilled artisan will understand that typically there is no limit on the number of items or terms in any combination, unless otherwise apparent from the context.

As used herein, words of approximation such as, without limitation, "about", "substantial" or "substantially" refers to a condition that when so modified is understood to not necessarily be absolute or perfect but would be considered close enough to those of ordinary skill in the art to warrant designating the condition as being present. The extent to which the description may vary will depend on how great a change can be instituted and still have one of ordinary skilled in the art recognize the modified feature as still having the required characteristics and capabilities of the unmodified feature. In general, but subject to the preceding discussion, a numerical value herein that is modified by a word of approximation such as "about" may vary from the stated value by at least ±1, 2, 3, 4, 5, 6, 7, 10, 12, 15, 20 or 25%.

All of the devices and/or methods disclosed and claimed herein can be made and executed without undue experimentation in light of the present disclosure. While the devices and methods of this invention have been described in terms of preferred embodiments, it will be apparent to those of skill in the art that variations may be applied to the devices and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

What is claimed is:

1. A smoke clearing and cooling insert assembly for use with a smoking implement, the insert assembly comprising:

a rigid outer shell with an inner elongated well and at least one opening leading thereto, an elastic elongated stem insert configured for insertion into the inner well through said at least one opening and for removably retaining inside thereof, said elastic stem insert having a convoluted serpentine groove extending from one end thereof to an opposite end thereof, wherein when said insert assembly is put together, said the outer shell and said elastic stem insert defining a convoluted serpentine smoke pathway formed between said serpentine grove and the inner wall of said outer shell, and wherein said elastic elongated stem insert is sized to be larger than said inner elongated well, thereby during assembly of said smoke clearing and cooling insert assembly, said elastic elongated stem insert is compressed and elastically deformed to remain inside said outer shell, and wherein said elastic elongated stem insert comprises a side rib extending from said one end of the convoluted smoke pathway to the opposite end thereof and a plurality of circular ribs, together forming said convoluted serpentine groove, and wherein the outer shell is configured to attach to the smoking implement and to cause smoke to travel inside thereof during smoke inhalation towards one end of the convoluted serpentine smoke pathway, and wherein the smoke is caused to travel through the convoluted serpentine smoke pathway and then directed towards a mouthpiece from the other end thereof, thereby causing cooling and clearing of the smoke from undesirable debris while traveling through the insert assembly.

2. The insert assembly as in claim 1, wherein said rigid outer shell is made from a thermo-conductive material.

3. The insert assembly as in claim 1, wherein said outer shell is made from metal.

4. The insert assembly as in claim 1 further comprising a replaceable mouthpiece configured to be removably attached to said rigid outer shell.

5. The insert assembly as in claim 1, wherein said serpentine grove is at least two inches long.

6. The insert assembly as in claim 1, wherein each of said circular ribs extends from one side of said side rib towards the other side thereof, each of said circular ribs forms a gap with said side rib on either side thereof.

7. The insert assembly as in claim 6, wherein said gaps between said circular ribs and said side rib are located on alternating sides of said side rib so as to form portions of said convoluted serpentine groove extending in alternating directions around said stem insert.

8. The insert assembly as in claim 1, wherein said circular ribs are spaced evenly along said stem insert.

9. The insert assembly as in claim 1, wherein said circular ribs are positioned closer together on one side of said stem insert as compared with the other side of said stem insert.

10. The insert assembly as in claim 1, wherein said circular ribs are equipped with the tips configured for cleaning said inner well of said outer shell from smoking debris upon removing of said stem insert therefrom.

11. The insert assembly as in claim 10, wherein said tips are selected from a group of tips consisting of: an enlarged square tip, a straight square tip, a bent pointed tip, a straight pointed tip, a rounded tip, and a bulbous tip.

12. The insert assembly as in claim 1, wherein said smoking implement is a bong with an outlet port, said outer shell is sized and configured to fit inside the outlet port.

* * * * *